US011022285B2

(12) United States Patent
Recor et al.

(10) Patent No.: US 11,022,285 B2
(45) Date of Patent: Jun. 1, 2021

(54) LIGHT ASSEMBLY

(71) Applicant: FADE STUDIO INC., San Francisco, CA (US)

(72) Inventors: Bret Recor, San Francisco, CA (US); Seth Murray, Piedmont, CA (US); Matthew Swinton, San Francisco, CA (US); Hsiao-wei Chang, Tainan (TW); Wen-pin Tsai, Tainan (TW)

(73) Assignee: Scott Soong, Orinda, CA (US)

( * ) Notice: Subject to any disclaimer, the term of this patent is extended or adjusted under 35 U.S.C. 154(b) by 0 days.

(21) Appl. No.: 16/860,092

(22) Filed: Apr. 28, 2020

(65) Prior Publication Data

US 2020/0256550 A1 Aug. 13, 2020

Related U.S. Application Data

(62) Division of application No. 15/173,605, filed on Jun. 3, 2016, now Pat. No. 10,683,999.

(60) Provisional application No. 62/170,678, filed on Jun. 3, 2015.

(51) Int. Cl.

| | |
|---|---|
| ***F21V 19/02*** | (2006.01) |
| ***F21V 21/26*** | (2006.01) |
| ***F21S 6/00*** | (2006.01) |
| ***F21S 8/00*** | (2006.01) |
| ***F21V 21/30*** | (2006.01) |
| ***F21V 23/00*** | (2015.01) |
| *F21Y 115/10* | (2016.01) |

(52) U.S. Cl.

CPC ..... *F21V 21/26* (2013.01); *F21S 6/005* (2013.01); *F21S 8/033* (2013.01); *F21V 21/30* (2013.01); *F21V 23/007* (2013.01); *F21Y 2115/10* (2016.08)

(58) Field of Classification Search

CPC ..... F21V 21/26; F21V 21/30; F21V 23/007; F21V 21/096; F21V 23/0442; F21V 21/35; F21V 23/00; F21S 6/005; F21S 8/033; F21Y 2115/10

USPC ..... 362/285, 386, 398, 427, 421, 581, 129, 362/220, 249.03, 249.04, 249.07

See application file for complete search history.

(56) References Cited

U.S. PATENT DOCUMENTS

| | | | | |
|---|---|---|---|---|
| 4,979,081 | A | 12/1990 | Leach et al. | |
| 5,067,764 | A | 11/1991 | Lanser et al. | |
| 2004/0090602 | A1* | 5/2004 | Imade | G02B 27/1033 353/102 |
| 2013/0169154 | A1* | 7/2013 | Kay | H05B 45/37 315/81 |
| 2014/0355268 | A1* | 12/2014 | Wood | F21S 6/00 362/268 |

(Continued)

FOREIGN PATENT DOCUMENTS

| | | | |
|---|---|---|---|
| DE | 102009037019 | A1 | 3/2011 |

*Primary Examiner* — William J Carter
*Assistant Examiner* — Omar Rojas Cadima
(74) *Attorney, Agent, or Firm* — Su IP Consulting

(57) ABSTRACT

A lighting control unit of a light assembly includes a first plate, a power circuit board configured to receive power for the light assembly, a light blender configured to transform movement information into one or more control signals to modify one or more lighting parameters associated with a light source of the light assembly, and a second plate with a first side, wherein the light blender is mounted on the first side, and the second plate is rotatable in relation to the first plate.

10 Claims, 10 Drawing Sheets

(56) References Cited

U.S. PATENT DOCUMENTS

| | | | | |
|---|---|---|---|---|
| 2015/0108904 | A1* | 4/2015 | Chen | H03K 17/133<br>315/153 |
| 2015/0369418 | A1 | 12/2015 | Wong et al. | |
| 2016/0356466 | A1 | 12/2016 | Recor et al. | |

* cited by examiner

LIGHT ASSEMBLY

CROSS REFERENCE TO RELATED APPLICATION

The present application is a divisional application of U.S. Nonprovisional application Ser. No. 15/173,605, filed Jun. 3, 2016 and entitled "LIGHT ASSEMBLY", which claims the benefit of the U.S. Provisional Application Ser. No. 62/170,678, filed Jun. 3, 2015. The U.S. Nonprovisional Application and the U.S. Provisional Application, including any appendices or attachments thereof, are hereby incorporated by reference in their entirety.

BACKGROUND

Unless otherwise indicated herein, the approaches described in this section are not prior art to the claims in this application and are not admitted to be prior art by inclusion in this section.

A conventional light assembly typically includes a frame, a light socket to hold a light source and allow for its replacement, and an electrical connection to a power source. The light source produces visible light by the flow of electric current. However, many conventional light assemblies merely generate visible light but fail to control the various properties of the generated light. Many conventional light assemblies also lack aesthetic appeal.

SUMMARY

In accordance with one embodiment of the present disclosure, an arm of a light assembly includes a frame with a sleeve configured to receive a first hinge support, wherein the sleeve and the first hinge support define a first groove, a magnet coupled to the first hinge support, and a hinge mounted on the magnet, wherein the hinge is movable along the first groove.

In accordance with another embodiment of the present disclosure, a lighting control unit of a light assembly includes a first plate, a power circuit board configured to receive power for the light assembly, a light blender configured to transform movement information into one or more control signals to control one or more lighting parameters associated with a light source of the light assembly, and a second plate with a first side, wherein the light blender is mounted on the first side, and the second plate is rotatable in relation to the first plate.

In accordance with yet another embodiment of the present disclosure, a light assembly includes an arm and a lighting control unit. The arm includes a frame, a hinge, and a magnet, wherein the hinge is in contact with the magnet and is movable along a groove within the frame. The lighting control unit includes a first plate, a power circuit board configured to receive power for the light assembly, a light blender configured to transform movement information into one or more control signals to control one or more lighting parameters associated with a light source of the light assembly, and a second plate with a first side, wherein the light blender is mounted on the first side, and the second plate is rotatable in relation to the first plate.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are therefore not to be considered limiting of its scope, the disclosure will be described with additional specificity and detail through use of the accompanying drawings.

DETAILED DESCRIPTION

Figure 1:
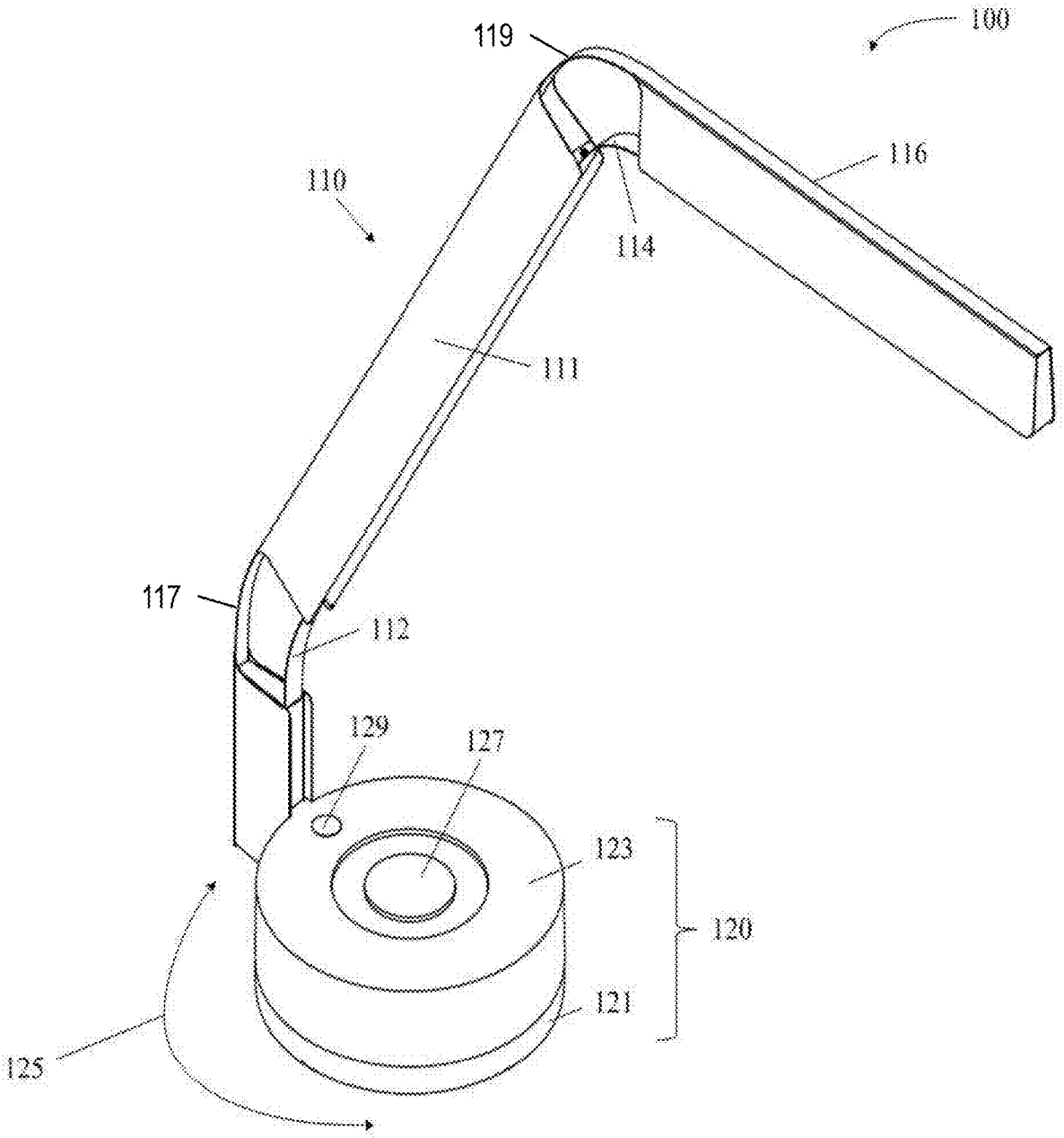
FIG. 1 is a side view of an example light assembly.

FIG. 1 is a side view of an example light assembly 100, arranged in accordance with at least some embodiments of the present disclosure. The light assembly 100 includes an arm 110 and a lighting control unit 120. The arm 110 includes a frame 111, a first hinge 112, a second hinge 114, and a light source 116. Some examples of the light source 116 include, without limitation, a light-emitting diode (LED) lamp, a halogen lamp, an incandescent light bulb, and others. The lighting control unit 120 includes at least a base 121 and a cover 123, together forming an enclosure. The cover 123 also includes a light blender 127 and a power button 129. In some embodiments, the light blender 127 may include multiple components, which will be further described in subsequent paragraphs and in junction with FIG. 4.

Figure 3A:
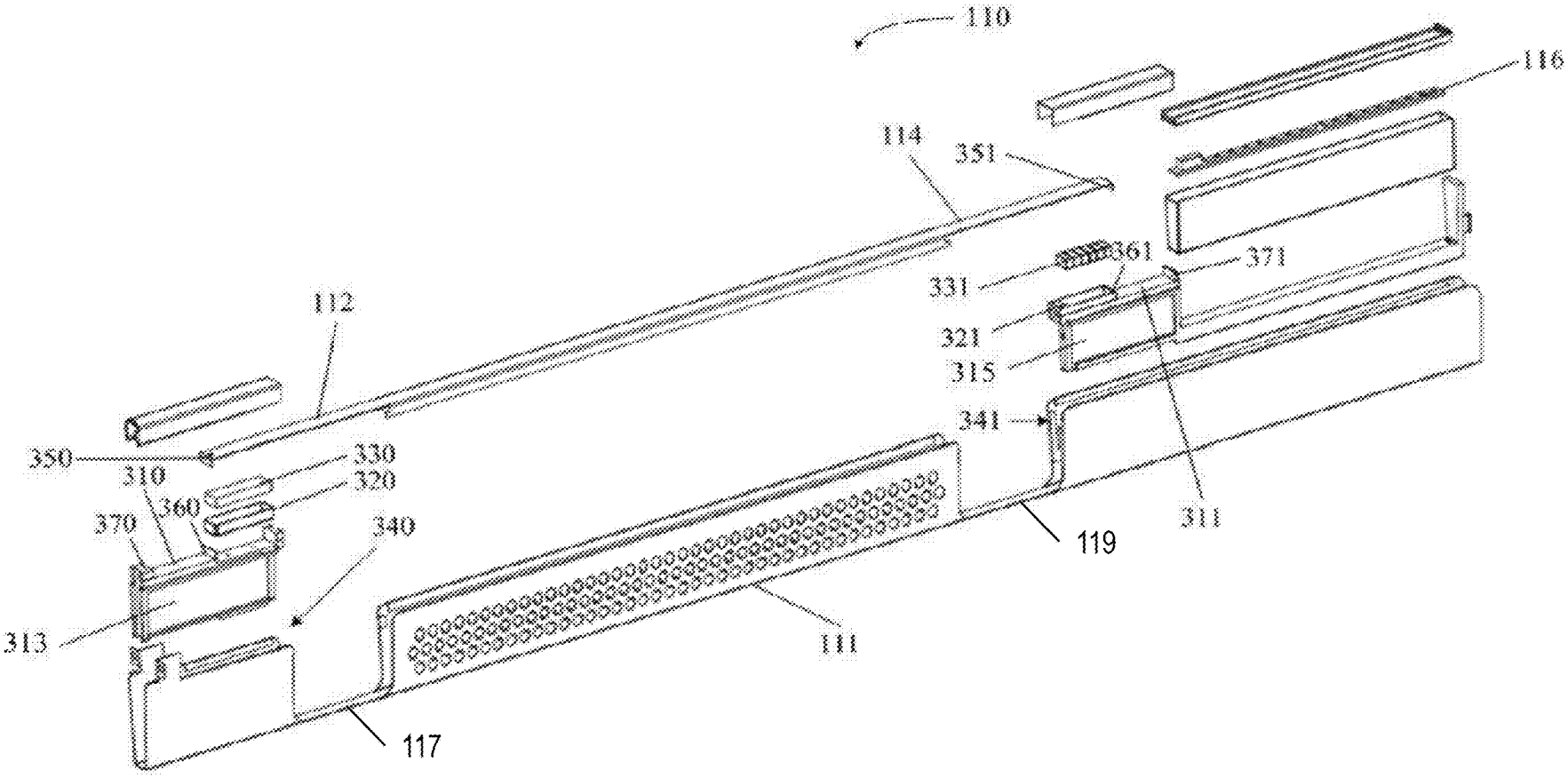
FIG. 3A is an exploded view of an example arm of a light assembly.

In some embodiments, the first hinge 112 and the second hinge 114 may be strips of a bendable and magnetic material, so that the hinges can be attracted to magnets. For example, the strips may be made of galvanized iron. Also, the first hinge 112 and the second hinge 114 may correspond to two ends of a single strip (as shown in FIG. 3A). Alternatively, the first hinge 112 and the second hinge 114 may correspond to physically separate strips. Details of the hinge movement will be further described in subsequent paragraphs and in junction with FIG. 3.

The frame 111, which includes a first joint 117 and a second joint 119, is configured to bend or straighten at the two joints.

In some embodiments, the light source 116 may be configured to electrically connect to a power source through a wired connection (not shown) in the frame 111. The wired connection may be placed in the base 121. Some examples of the power source include, without limitation, alternative current (AC) power supply, batteries, and others. Alternatively, the light source 116 may be configured to electrically and wirelessly connect to a power source. The power source may be external to the light assembly 100 (e.g., AC wall socket) or inside the lighting control unit 120 (e.g., batteries).

In some embodiments, the cover 123 can be rotated in either a counterclockwise direction or a clockwise direction as represented by an arrow 125. The rotation of the cover 123 may occur while the base 121 remains stationary. When the arm 110 is coupled to the cover 123, the rotation of the cover 123 and the rotation of the arm 110 and the light source 116 would occur in tandem.

Figure 2A:
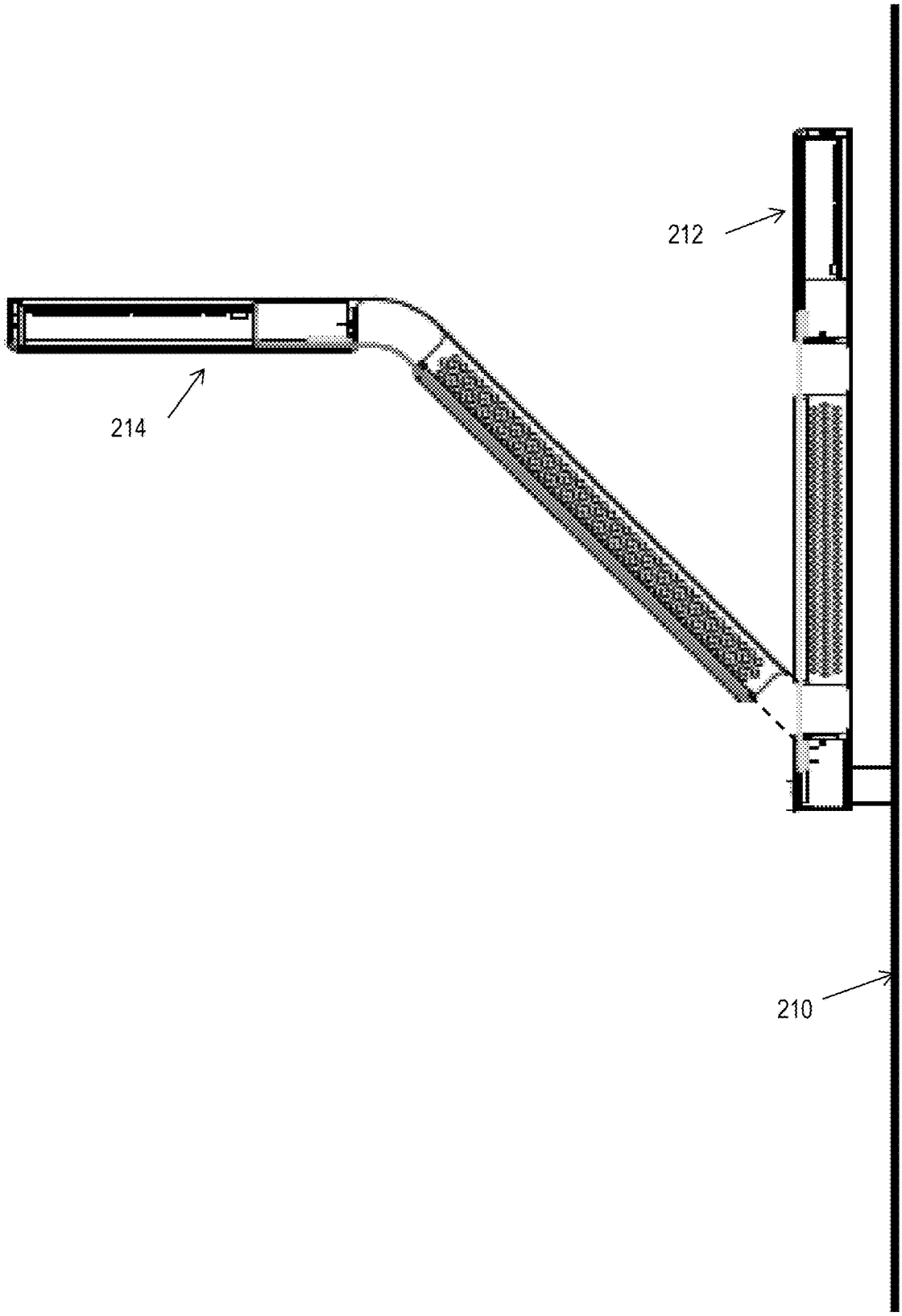
FIG. 2A and 2B illustrate alternative configurations of an arm of a light assembly.
Figure 2B:
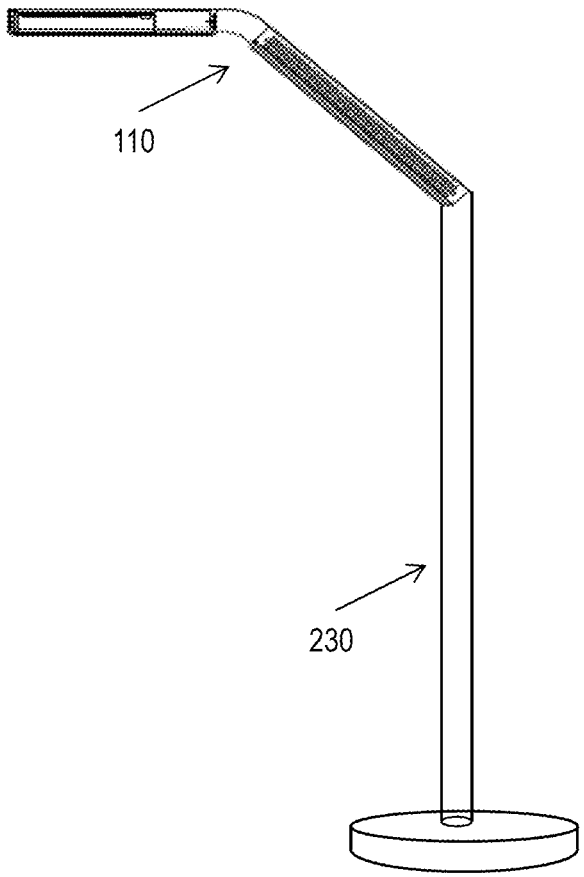

FIG. 2A and 2B illustrate some alternative configurations of the arm 110, arranged in accordance with at least some embodiments of the present disclosure. In FIG. 2A, the arm 110 is shown to mount on a wall 210 and may be movable between, for example, a first position 212 and a second position 214. In FIG. 2B, the arm 110 is shown to couple to a floor-standing base 230. Any technically feasible mechanism may be employed to attach the arm 110 to the wall 210 and the floor-standing base 230.

In alternative embodiments, the lighting control unit 120 may not be coupled to the arm 110. For example, the lighting control unit 120 may be mounted on a wall structure and may be used to control ambient lighting in a room. The lighting control unit 120 may also come in other shapes, such as a square, a rectangle, and others.

FIG. 3A is an exploded view of an example arm of a light assembly, arranged in accordance with some embodiments of the present disclosure. The example arm shown in FIG. 3A corresponds to the arm 110 illustrated in FIG. 1. The frame 111 includes three separate sections, which are connected by the first joint 117 and the second joint 119. A first section of the frame 111, located near one end of the frame, includes a first sleeve 340, which is configured to receive a first hinge support 313. Similarly, a second section of the frame 111, located near the other end of the frame, includes a second sleeve 341, which is configured to receive a second hinge support 315.

In some embodiments, the first hinge support 313 and the second hinge support 315 may be inserted into the first sleeve 340 and the second sleeve 341, respectively. To provide stability to the light assembly, the first hinge support 313 may be heavier than the second hinge support 315. The width of the first hinge support 313 may be greater than the width of the first sleeve 340. Therefore, after inserting the first hinge support 313 into the first sleeve 340, the first hinge support 313 may be secured to the first sleeve 340. Similarly, the width of the second hinge support 315 may also be greater than the width of the second sleeve 341 so that the second hinge support 315 may be secured to the second sleeve 341 after the insertion of the support into the sleeve.

In some embodiments, a first magnet 330 may be directly coupled to the first hinge support 313, and a second magnet 331 may be directly coupled to the second hinge support 315. Alternatively, if the first hinge 112 and the second hinge 114 are made of a material that responds weakly to the first magnet 330 and the second magnet 331 (e.g., a material with heavy coating), respectively, the first magnet 330 and the second magnet 331 may be enclosed in a first case 320 and a second case 321, respectively. The first case 320, which is mounted on the first hinge support 313, and the second case 321, which is mounted on the second hinge support 315, may be made of a ferromagnetic material, such as, without limitation, galvanized iron.

In some embodiments, the first hinge 112 is configured to be in contact with the first magnet 330, and the second hinge 114 is configured to be in contact with the second magnet 331 to take advantage of the magnetic force. The first hinge 112 includes a first hook 350 at one end of the first hinge 112. The first hinge 112 is configured to move in a first groove 310, a confined space defined by the sleeve 340 and the first hinge support 313, between a first end 360 and a second end 370 of the first groove 310. Similarly, the second hinge 114 also includes a second hook 351 at one end of the second hinge 114. The second hinge 114 is configured to move in a second groove 311, a confined space defined by the sleeve 341 and the second hinge support 315, between a first end 361 and a second end 371 of the second groove 311.

Figure 3B:
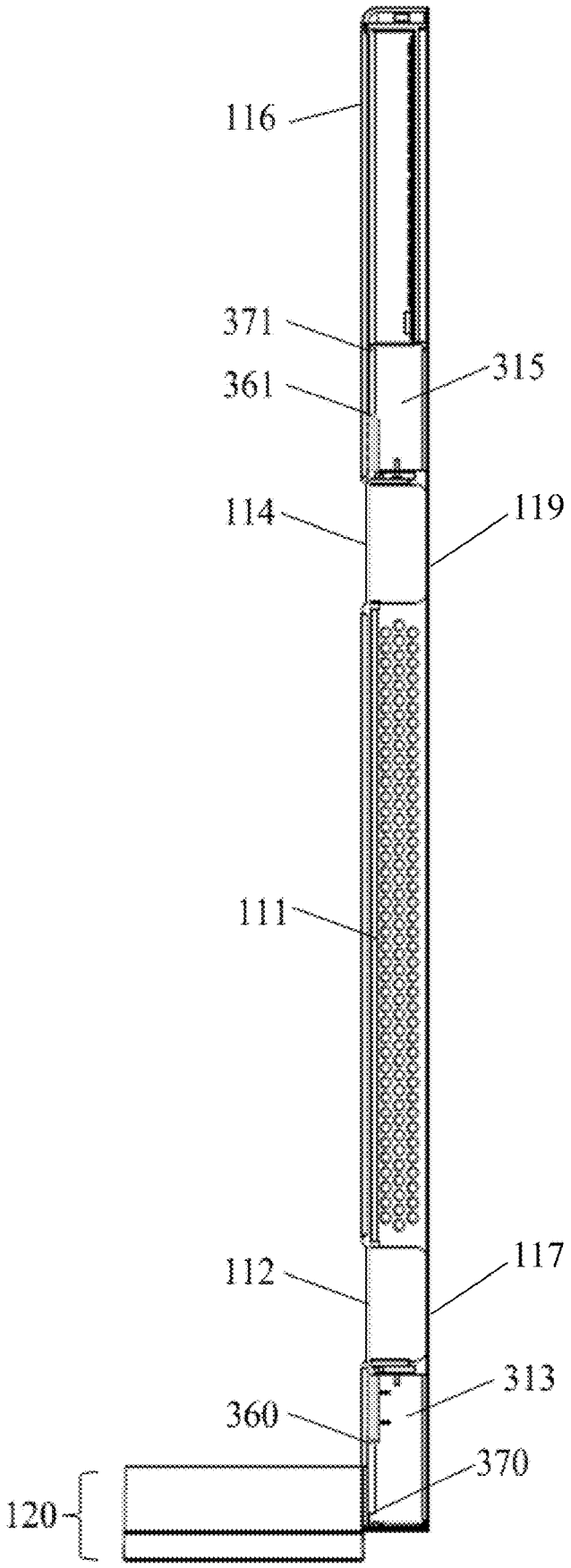
FIGS. 3B, 3C, and 3D are side views of an example light assembly in different positions to illustrate the movement of its hinges.
Figure 3C:
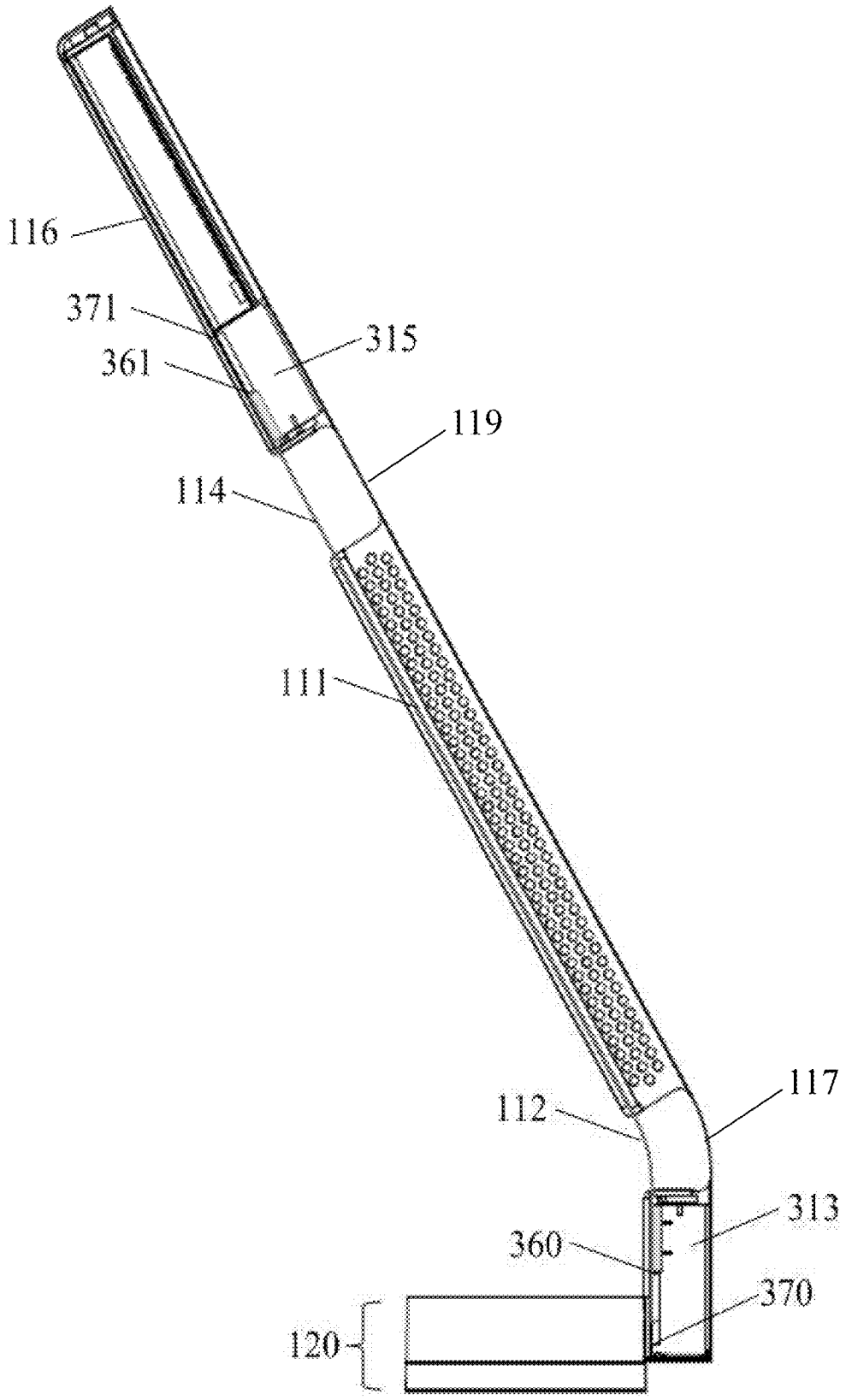
Figure 3D:
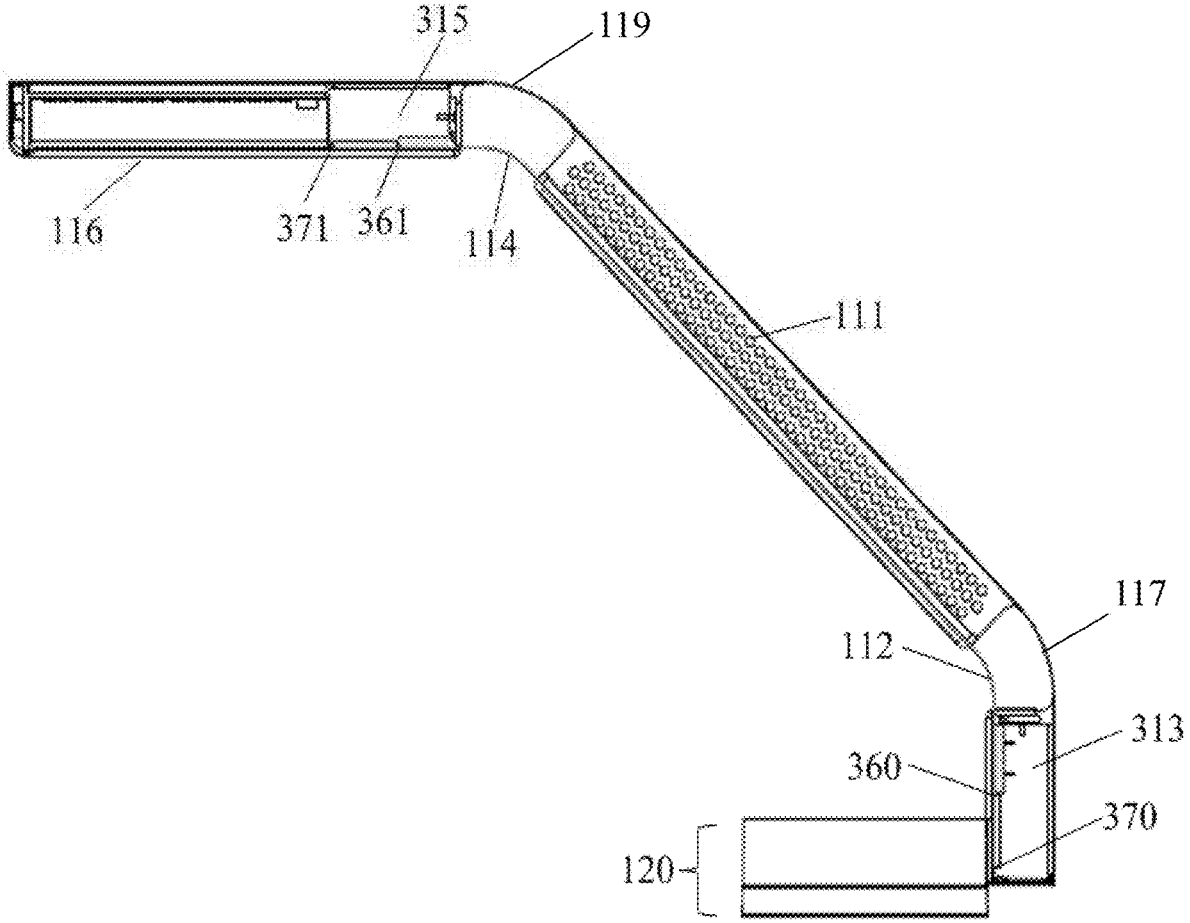

FIGS. 3B, 3C, and 3D are side views of an example light assembly in different positions to illustrate the movement of its hinges, arranged in accordance with some embodiments of the present disclosure. In conjunction with FIG. 3A, in FIG. 3B, the frame 111, the first hinge support 313, and the second hinge support 315 remain in a substantially straight line position. In this position, the first hook 350 of the first hinge 112 is at the first end 360 of the first groove 310, and the second hook 351 of the second hinge 114 is at the second end 371 of the second groove 311.

In conjunction with FIG. 3A, in FIG. 3C, the frame 111 bends in relation to the lighting control unit 120. As a result of the bending motion, the first hook 350 of the first hinge 112 moves from the first end 360 towards to the second end 370 of the first groove 310. The frame 111 will not be able to bend any further at the joint 117 once the first hook 350 reaches the second end 370.

In conjunction with FIG. 3A, in FIG. 3D, the light source 116 bends in relation to the frame 111. As a result of the bending motion, the second hook 351 of the second hinge 114 moves from the second end 371 towards the first end 361 of the second groove 311. The light source 116 will not be able to bend any further at the joint 119 once the second hook 351 reaches the first end 361.

Figure 4:
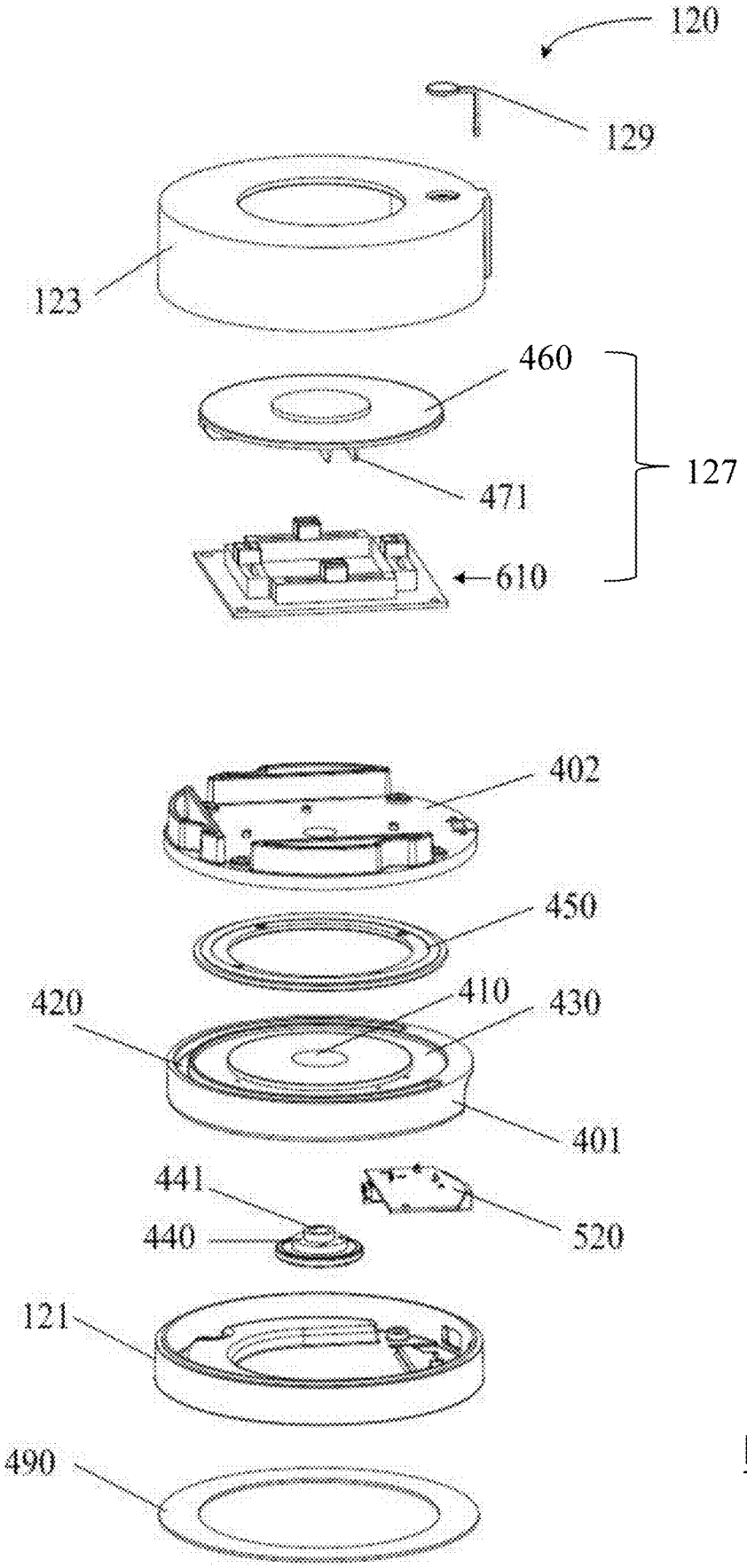
FIG. 4 is an exploded view of an example lighting control unit of a light assembly.

FIG. 4 is an exploded view of an example lighting control unit of a light assembly, arranged in accordance with some embodiments of the present disclosure. The example lighting control unit shown in FIG. 4 corresponds to the lighting control unit 120 illustrated in FIG. 1.

In some embodiments, the lighting control unit 120 includes the cover 123 and the base 121. An anti-skit pad 490 may be attached to the base 121. As shown in FIG. 4, the cover 123 and the base 121 form the enclosure, which houses at least a disc 440, a power circuit board 520, a first plate 401, a shim 450, a second plate 402, the light blender 127 of FIG. 1, which may include a position-to-signal converter 610 and a position generator 460.

The first plate 401 complements a second plate 402. The first plate 401 defines a first opening 410, a first channel 420, and a second channel 430. The second plate 402 includes a cylindrical rod (not shown here but shown in FIG. 6A) configured to engage with the first opening 410 and a disc 440, so that the second plate 402 can rotate in relation to the first plate 401, and the first plate 401 and the second plate 402 can be held together. Subsequent paragraphs will provide additional details of the relationships among the first plate 401, the second plate 402, and the disc 440. The disc 440 may be made of a soft or elastic material, for example, rubber, plastic, and others. The shim 450 is configured to be disposed in the second channel 430.

In some embodiments, the power circuit board 520 may be disposed on one side of the first plate 401, and the position-to-signal converter 610 may be mounted on one side of the second plate 402. The power circuit board 520 is electrically connected to a power source of the light assembly and is configured to regulate the current for the light source 116. The position-to-signal converter 610, coupled to the position generator 460, is configured to influence various lighting parameters, such as, without limitation, brightness and correlated color temperature of the light source 116. Subsequent paragraphs will provide additional details for the position-to-signal converter 610.

Figure 5A:
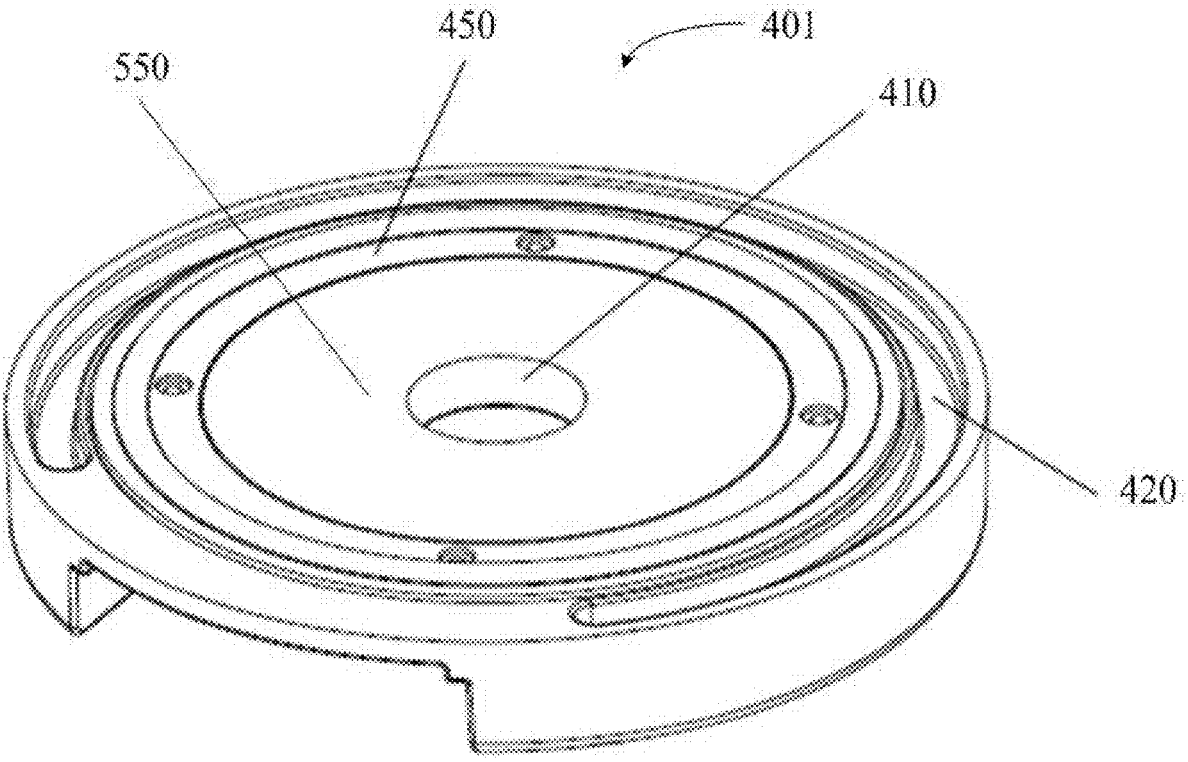
FIGS. 5A and 5B are top and bottom views of an example first plate of a lighting control unit.

FIG. 5A is top view of the first plate 401 of the lighting control unit 120, arranged in accordance with some embodiments of the present disclosure. In conjunction with FIG. 4, the shim 450 may be disposed in the second channel 430 on a top side of the first plate 401 to decrease the friction between the first plate 401 and the second plate 402. The shim 450 may be made of a soft or elastic material, for example, rubber, plastic, and others. In some embodiments, the first plate 401 may have a circular region 550, which defines the first opening 410.

Figure 5B:
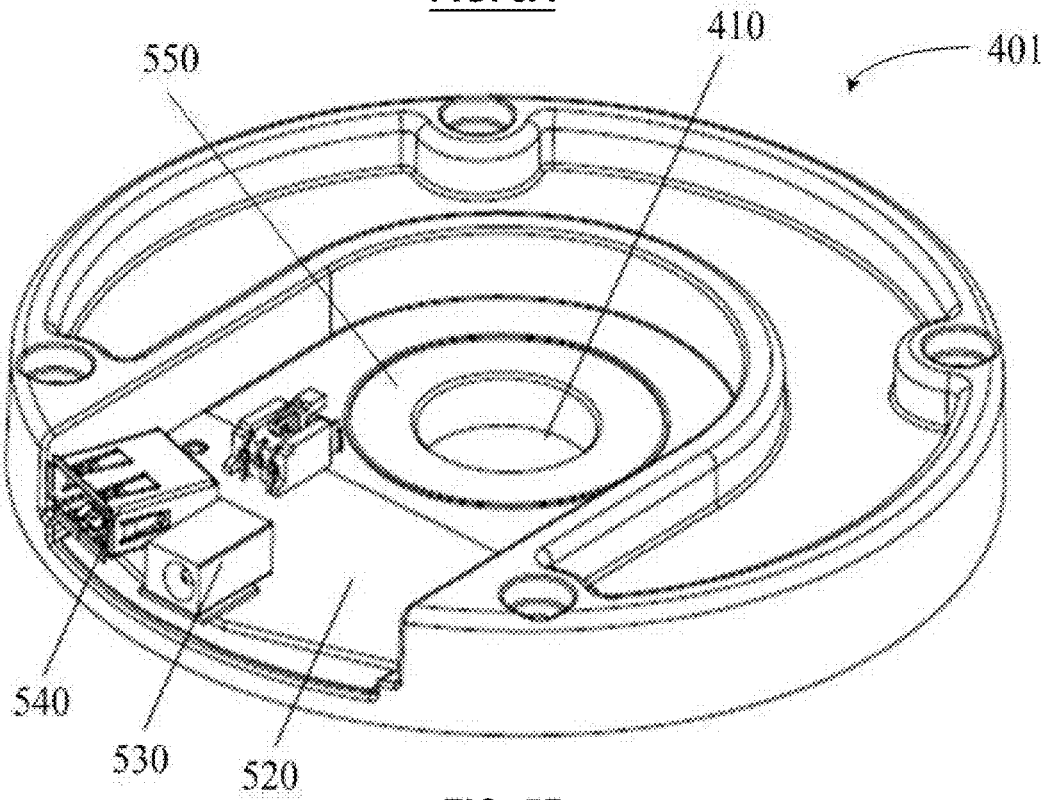

FIG. 5B is bottom view of the first plate 401 of the lighting control unit 120, arranged in accordance with some embodiments of the present disclosure. In conjunction with FIG. 4, the power circuit board 520 may be disposed on a bottom side of the first plate 401, and the power circuit board 520 may include an AC/DC port 530 and a USB port 540. Any wiring coupled to the power circuit board 520 may come through the first opening 410. As shown, the thickness of the circular region 550 is less than the thickness of the outer rim of the first plate 401.

Figure 6A:
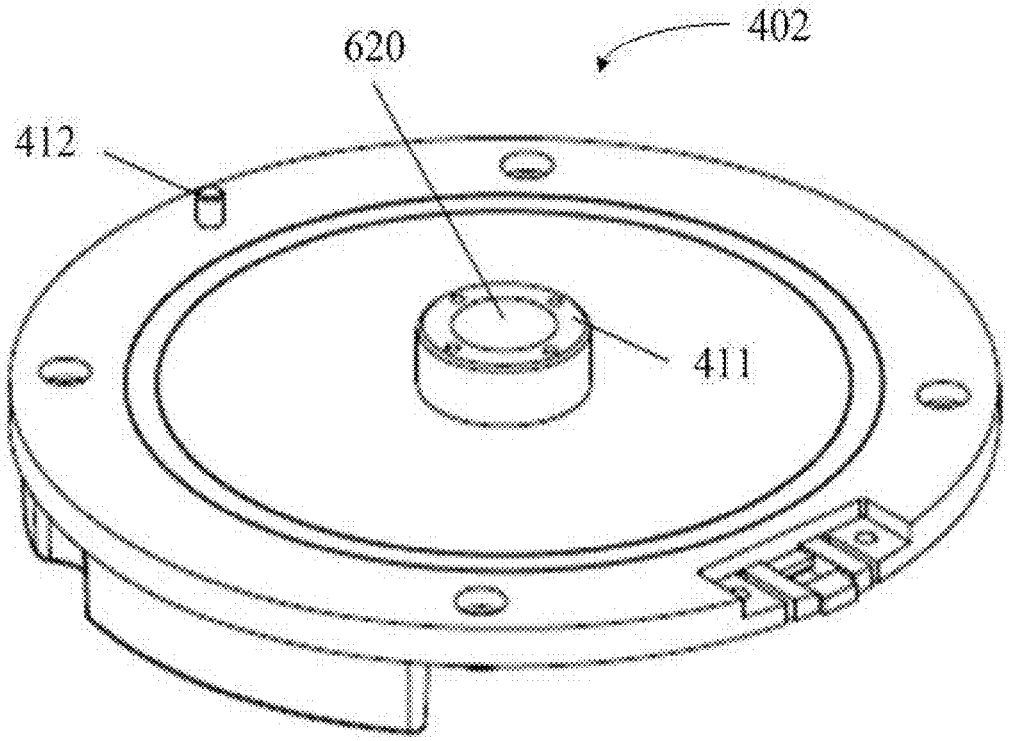
FIGS. 6A and 6B are top and bottom views of an example second plate of a lighting control unit, all arranged in accordance with some embodiments of the present disclosure.

FIG. 6A is a bottom view of the second plate 402 of the lighting control unit 120, arranged in accordance with some embodiments of the present disclosure. In some embodiments, the second plate 402 includes a stud 412 and a cylindrical rod 411. In conjunction with FIG. 4 and FIG. 5A, the stud 412 is configured to be disposed in the first channel 420 of the first plate 401. The stud 412 may move along the first channel 420 to facilitate the rotation between the first plate 401 and the second plate 402. The cylindrical rod 411 may be hollow, and when the cylindrical rod 411 is inserted through the first opening 410 of the first plate 401, a path 620 through the first plate 401 and the second plate 402 can be defined.

For the second plate 402 to rotate while remaining coupled to the first plate 401, in some embodiments, in conjunction with FIG. 4, the disc 440 may be disposed on the bottom side of the first plate 401, with its protrusion 441 inserted in the path 620. To hold the first plate 401 and the second plate 402 together, in conjunction with FIG. 4, the disc 440 may have four holes that match the four holes on the cylindrical rod 411 as shown in FIG. 6A, and with the protrusion 441 inserted in the path 620, the disc 440 may be secured to the cylindrical rod 411 with screws through the four holes.

To enable a smooth rotation motion between the first plate 401 and the second plate 402, in some embodiments, the height of the cylindrical rod 411 is greater than the thickness of the circular region 550. To illustrate, in conjunction with FIG. 5A and FIG. 6A, after inserting the cylindrical rod 411 through the first opening 410 so that the complementary first plate 401 and the second plate 402 are coupled, a portion of the cylindrical rod 411 would extend above the surface of the circular region 550. Thus, when the disc 440 is secured on the cylindrical rod 411, the disc 440 is not in contact with the surface of the circular region 550. Without this physical contact, the second plate 402 could rotate about the cylindrical rod 411 as an axis smoothly.

Figure 6B:
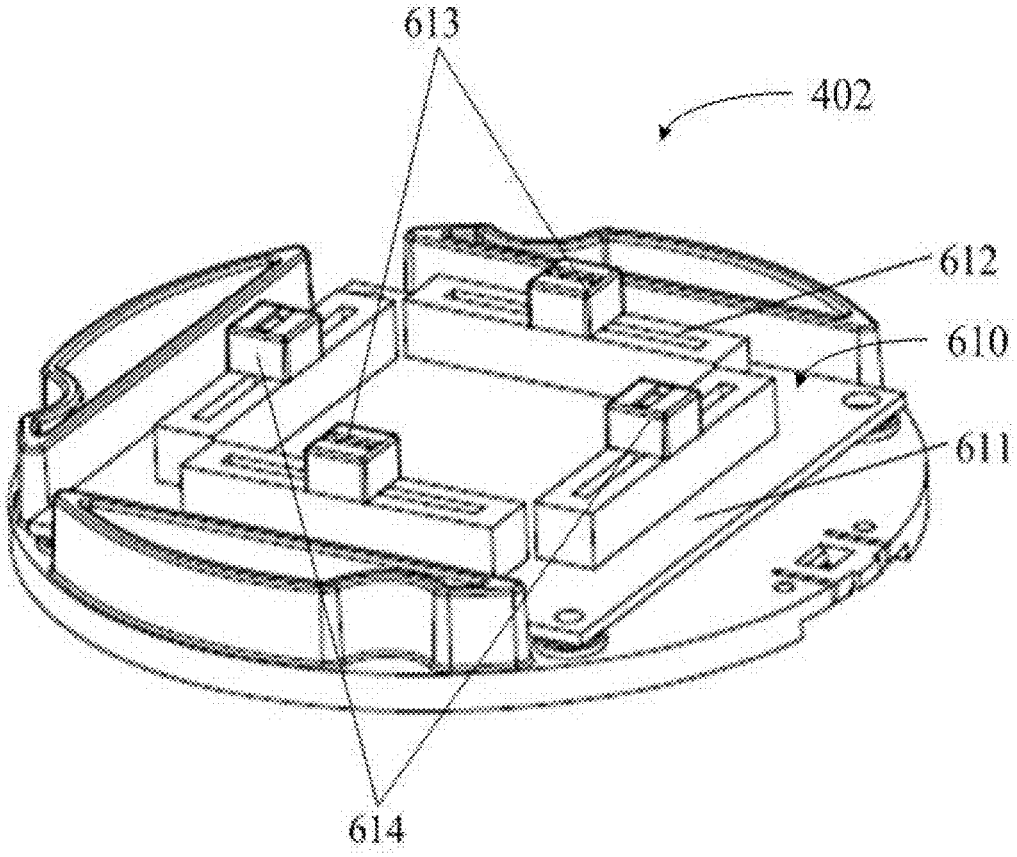

FIG. 6B is a top view of the second plate 402 of the lighting control unit 120, arranged in accordance with some embodiments of the present disclosure. In FIG. 6B, the position-to-signal converter 610 is configured to blend the brightness and the correlated color temperature (CCT) of the light source 116. In some embodiments, the position-to-signal converter 610 includes a control circuit board 611 and a plurality of variable resistors 612. In conjunction with FIG. 4, the position-to-signal converter 610 is coupled to the position generator 460. The illustrated position generator 460 includes tracks 471, which are configured to engage with hinge supports 613 and 614 of the variable resistors. Thus, in response to finger movement of a user touching the position generator 460, the movements of the position generator 460 may change the positions of the hinge supports 613 and 614. For example, in response to a movement along the longitudinal direction by the light blender, the hinge supports 613 may change their positions along the longitudinal direction while the hinge supports 614 remain still. In response to another movement along the transverse direction by the light blender, the hinge supports 614 may change their positions along the transverse direction while the hinge supports 613 remain still.

In some embodiments, the control circuit board 611 may be configured to generate a first control signal to control one lighting parameter (e.g., the brightness) of the light source 116 based on the positions of the hinge supports 613 and generate a second control signal to control another lighting parameter (e.g., the CCT) of the same light source 116 based on the positions of the hinge supports 614. By modifying multiple lighting parameters, the effect of blending brightness and lighting temperature is enhanced. The control circuit board 611 may be electrically connected to the light source 116 via a wired connection, which passes through the first opening 410 and the path 620. In response to the first control signal and the second control signal, the light source 116 may change multiple lighting parameters, such as the brightness and CCT, at the same time. Alternatively, the generated control signals are sent to the power circuit board 520, and the output of the power circuit board 520 is adjusted based on the control signals before delivering to the light source 116.

In alternative embodiments, the position generator 460 is free of the tracks 471. The position generator 460 may correspond to a computer mouse or a touchscreen, wherein the various positions generated by the moving the computer mouse or touching different parts of the touchscreen may be used by the position-to-signal converter 610 to generate control signals to blend the brightness, CCT, and other lighting parameters.

While the forgoing is directed to embodiments of the present disclosure, other and further embodiments of the disclosure may be devised without departing from the basic scope thereof, and the scope thereof is determined by the claim that follow.

We claim:

1. A lighting control unit of a light assembly, comprising:

a first plate;

a power circuit board configured to receive power for the light assembly;

a light blender configured to transform movement information into one or more control signals to modify one or more lighting parameters associated with a light source of the light assembly, wherein the light blender further comprises:

a position generator; and a position-to-signal converter, wherein the positioned-to-signal converter includes a plurality of variable resistors with hinge supports, and movement of the hinge supports in a first direction causes a first control signal for a first lighting parameter to be generated, and movement of the hinge supports in a second direction causes a second control signal for a second lighting parameter to be generated; and a second plate with a first side, wherein the light blender is mounted on the first side, and the second plate is rotatable in relation to the first plate.

2. The lighting control unit of claim 1, wherein the one or more lighting parameters include brightness and a correlated color temperature (CCT).

3. The lighting control unit of claim 1, wherein:

the first plate includes a first channel on a first side of the first plate and a first opening at a center of the first plate;

the second plate includes a cylindrical rod and a stud, and the cylindrical rod is inserted into the first opening, and the stud is placed in the first channel; and rotation of the second plate about the cylindrical rod as an axis causes the stud to move in the first channel.

4. The lighting control unit of claim 3, wherein the first plate further comprises:

a second channel on the first side of the first plate; and a shim disposed in the second channel.

5. The lighting control unit of claim 3, wherein the first opening is defined by a circular region of the first plate, and a height of the cylindrical rod is greater than a thickness of the circular region.

6. The lighting control unit of claim 3, wherein wiring for the power circuit board passes through the first opening.

7. The lighting control unit of claim 1, wherein the first plate, the second plate, and a disc are coupled together by inserting a protrusion of the disc into a cylindrical rod.

8. The lighting control unit of claim 1, further comprising:

a cover;

a base, coupled to the cover to form an enclosure that contains the first plate, the second plate, the power circuit board, the light blender; and a power button coupled to the power circuit board.

9. The lighting control unit of claim 1, wherein the position generator includes a touchscreen, wherein the touchscreen is configured to collect movement information associated with touches and transmit the collected movement information to the position-to-signal converter.

10. The lighting control unit of claim 9, wherein the position generator includes tracks, wherein the tracks are configured to engage with the hinge supports on the position-to-signal converter.

* * * * *